US005111677A

United States Patent [19]

Del Fabro et al.

[11] Patent Number: 5,111,677

[45] Date of Patent: May 12, 1992

[54] ORTHOGONAL ADJUSTMENT UNIT FOR STRAIGHTENING BARS

[75] Inventors: Marcello Del Fabro, Udine; Giorgio Del Fabro, Montegnacco, both of Italy

[73] Assignee: MEP Macchine Elettroniche Piegatrici SpA, Rojale, Italy

[21] Appl. No.: 643,682

[22] Filed: Jan. 23, 1991

Related U.S. Application Data

[63] Continuation of Ser. No. 463,446, Jan. 11, 1990, abandoned.

[30] Foreign Application Priority Data

Jan. 18, 1989 [IT] Italy ..... 15901 A/89

[51] Int. Cl.[5] ..... B21D 3/02

[52] U.S. Cl. ..... 72/164; 72/160; 72/247

[58] Field of Search ..... 72/160-165, 72/247

[56] References Cited

U.S. PATENT DOCUMENTS

| | | | |
|---|---|---|---|
| 1,054,022 | 2/1913 | Neller | 72/164 |
| 1,239,175 | 9/1917 | Gilbert | 72/164 |
| 2,095,474 | 10/1937 | Kinder | 72/164 |
| 2,136,714 | 11/1938 | Simons | 72/165 |
| 2,219,811 | 10/1940 | Friedman | 72/161 |
| 4,799,373 | 1/1989 | Benton | 72/219 |

FOREIGN PATENT DOCUMENTS

| | | | |
|---|---|---|---|
| 180901 | 2/1907 | Fed. Rep. of Germany . | |
| 380128 | 9/1923 | Fed. Rep. of Germany . | |
| 2518798 | 11/1976 | Fed. Rep. of Germany . | |
| 595071 | 11/1947 | United Kingdom | 72/160 |
| 1041849 | 9/1966 | United Kingdom | 72/164 |
| 1132609 | 11/1968 | United Kingdom . | |

*Primary Examiner*—Daniel C. Crane

*Attorney, Agent, or Firm*—Antonelli, Terry, Stout & Kraus

[57] ABSTRACT

Method for orthogonal adjustment of straightened bars and an orthogonal adjustment unit located downstream of a bar straightening machine, whereby the bars may be of a rolled, drawn or extruded type or be obtained with a forming machine and may have any round, oval, square, rectangular or polygonal, etc. section and be solid or hollow. A desired variable deformation opposed to the curved development determined by the last three staggered rolls (30-31-131) of a straightening assembly (11) is imparted to the bar (14-114) after the straightening and immediately downstream of the straightening assembly (11) by the orthogonal adjustment unit. The orthogonal adjustment unit includes at least one adjustment roll (13) which imparts deformation to the bar (14-114) by acting thereon radially in a desired position, within an angle of 360°, lying on a plane normal tothe nominal axis of the straightening machine working and having as its axis that nominal axis.

8 Claims, 2 Drawing Sheets

ORTHOGONAL ADJUSTMENT UNIT FOR STRAIGHTENING BARS

Figure 1A:
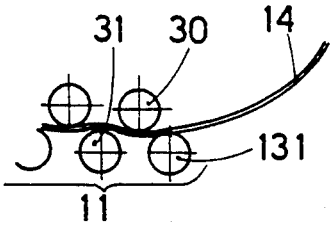

This application is a Continuation of application Ser. No. 07/463,446, filed Jan. 11, 1990, now abandoned.

This invention concerns an orthogonal adjustment unit that cooperates with a bar straightening machine. To be more exact, the invention concerns an orthogonal adjustment unit which, by working between the straightening machine and a contrast unit and being located immediately downstream of the straightening machine, enables a bar leaving the straightening machine to be correctly straightened.

According to the invention the contrast unit may consist also of, or act as, a means to measure length. We shall deal hereinafter with the case where the contrast unit acts as a means to measure length but will also cover other possible cases.

The invention concerns also a method for the orthogonal straightening of a straightened bar, namely by working on an angle of 360°.

It is known that the straightening of bars takes place by making them pass through a straightening machine.

By bars is meant here any linear element having a cylindrical, oval, square, rectangular, etc. and solid or hollow section with an outer surface which is smooth or bears projections or other shapes comprised in reinforcement bars, for instance.

The bars according to this invention may be rolled, drawn, extruded, formed, etc.

Various systems have been devised to obtain straightened bars since the last three rolls (30-31-131) in a straightening assembly (FIG. 1) perform a known extending function. The lay-out of these three rolls (30-31-131) is indifferent as also is the choice whether the lower or upper or both sets of rolls of the assembly should consist of powered rolls to carry out the drawing action too.

The cited extending function leads to the imparting of a curved development to the bar leaving the straightening assembly. This curved development may have a more or less marked appearance but it always exists.

Moreover, in the case of non-homogeneous or discontinuous sections (such as round bars shaped at their upper end for reinforcement purposes in building work) or of given materials, this curved development cannot lie on the plane containing the rolls or cannot always lie on the same plane as the rolls.

If a contrast unit (12) (FIG. 1*b*) is included downstream of the straightening assembly, this curved development is partly compensated by the straightening assembly, as taught in DE-C-380128.

Contrary to what DE-C-380128 states, the bar leaving the straightening assembly is never perfectly straightened if a system of that kind is employed.

This is even more true when the bar has a non-homogeneous section or has an irregular section.

Also, when the bar arrives from a reel, the final straightening is not perfect since auxiliary twists will have been imparted to that bar while it is being unwound from the reel.

DE-C-180901 tends to obviate this drawback with an automatic self-straightening system, which could be effective if the curved deformation remaining in the bar at the outlet of the straightening machine were to lie only on one plane (in this case a lengthwise vertical plane according to DE-C-180901).

But unfortunately, where the bars are non-homogeneous or have an irregular section or have been unwound from a reel, the remaining deformation often contains also developments oriented on other planes and not only on a vertical lengthwise plane.

DE-A-2518798 arranges to bend a tube according to a determined spiral by means of an orientation movement of the last rolls, but this document does not teach the straightening of a bar leaving a straightening machine with a residual deformation which may be oriented within an angle of 360°.

GB-A-1132609 too arranges to obtain desired deformations, that is, to obtain circles but not to straighten bars.

Various other systems have been designed by the present applicant to prevent the limitations of the known art. A first system disclosed in EP-A-02121.0 consists in placing at least two straightening assemblies substantially at a right angle to each other so as to process on two cartesian axes of the bar; in this case too the final outcoming bar retains this curved development, albeit to a small extent, in the cases cited above.

Another system disclosed in EP-A-0269157 provides for the creation of at least one half-loop in the bar passing through the straightening assembly, thereby fixing also the lengthwise twists due, for instance, to the unwinding of the bar from a reel.

These systems give good results but are costly as they require either the doubling of the straightening assembly or the construction of straightening assemblies having a curved development which entail considerable problems of setting-up, adjustment, construction, maintenance, etc.

As these assemblies cause very burdensome work, the simpler they are, the more the end-user is assisted, since the problems of maintenance, setting-up and adjustment are eliminated and the life of the device is improved.

To obviate these drawbacks and to achieve other advantages which will become clear in the following description, the present applicant has studied, tested and embodied this invention.

The invention is set forth in the main claims, while the dependent claims describe variants of the idea of the main solution.

According to the invention an orthogonal adjustment unit is positioned downstream of the straightening assembly and upstream of a contrast unit and can act on the bar in any position within 360°. The invention arranges that the straightening assembly and the contrast unit can lie substantially on the same plane, which can be substantially vertical or horizontal or in any other position between the vertical and horizontal, even at an angle inverted in relation to the axis of feed of the bar.

The invention provides for the orthogonal adjustment unit located upstream of the contrast unit, which will advantageously but not only act as a measurement unit, to be able to act on the bar at the same time along both the cartesian axes generating orthogonal planes, the original intersection of which coincides with the axis of the straightening machine.

According to the position taken up by the orthogonal adjustment unit, the bar on leaving the measurement unit takes up any three-dimensional positions within an angle of 360° created by a conoid the vertex of which lies between the rolls of the measurement unit, the axis of which coincides with the axis of the straightening machine and extends downstream thereof.

Figure 1B:
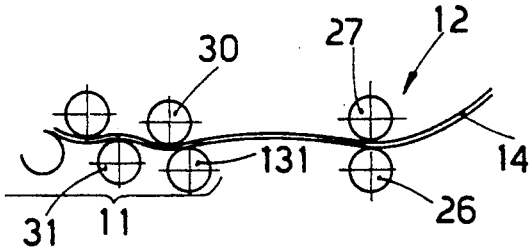
Figure 2:
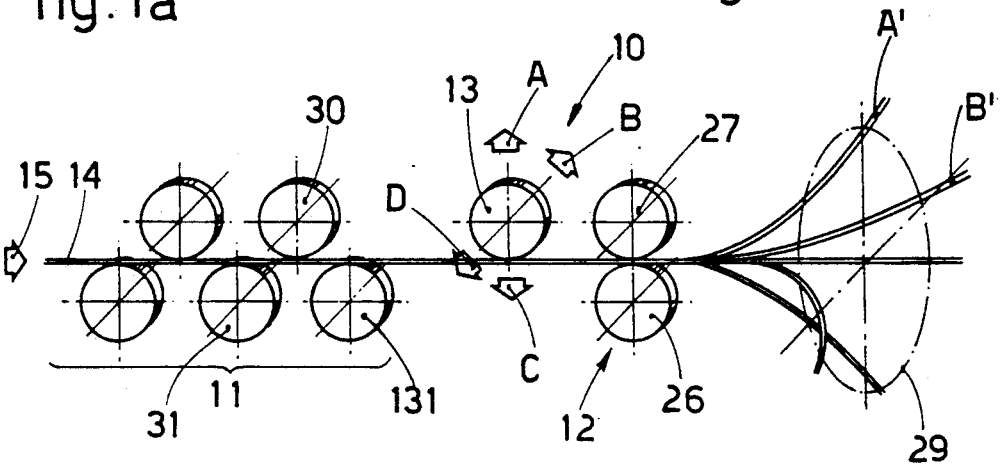
Figure 3:
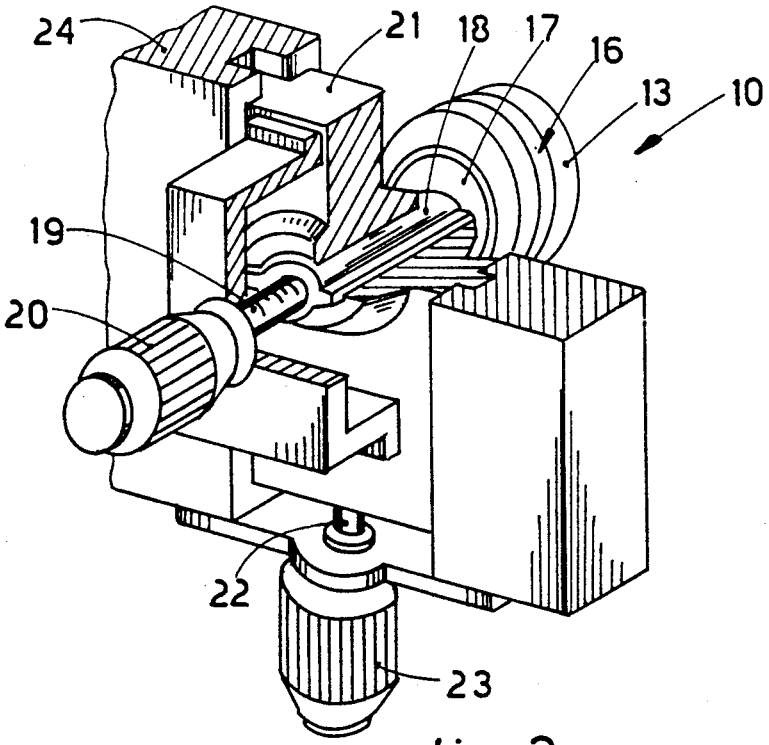
Figure 4:
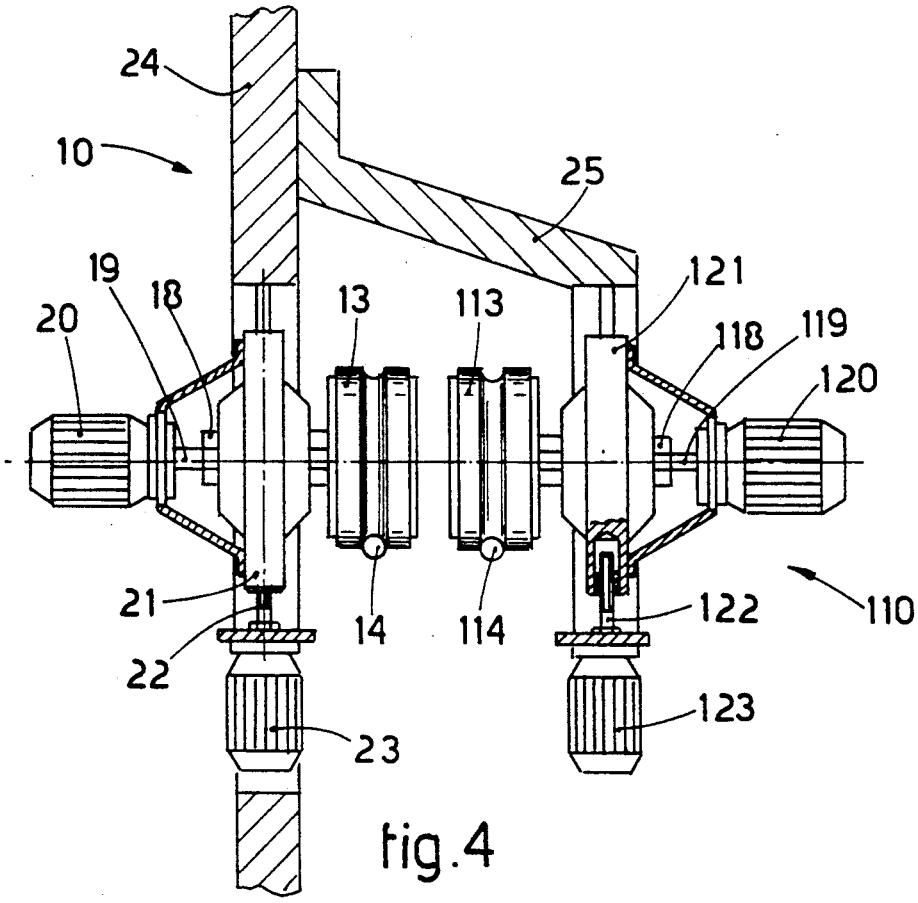
Figure 5:
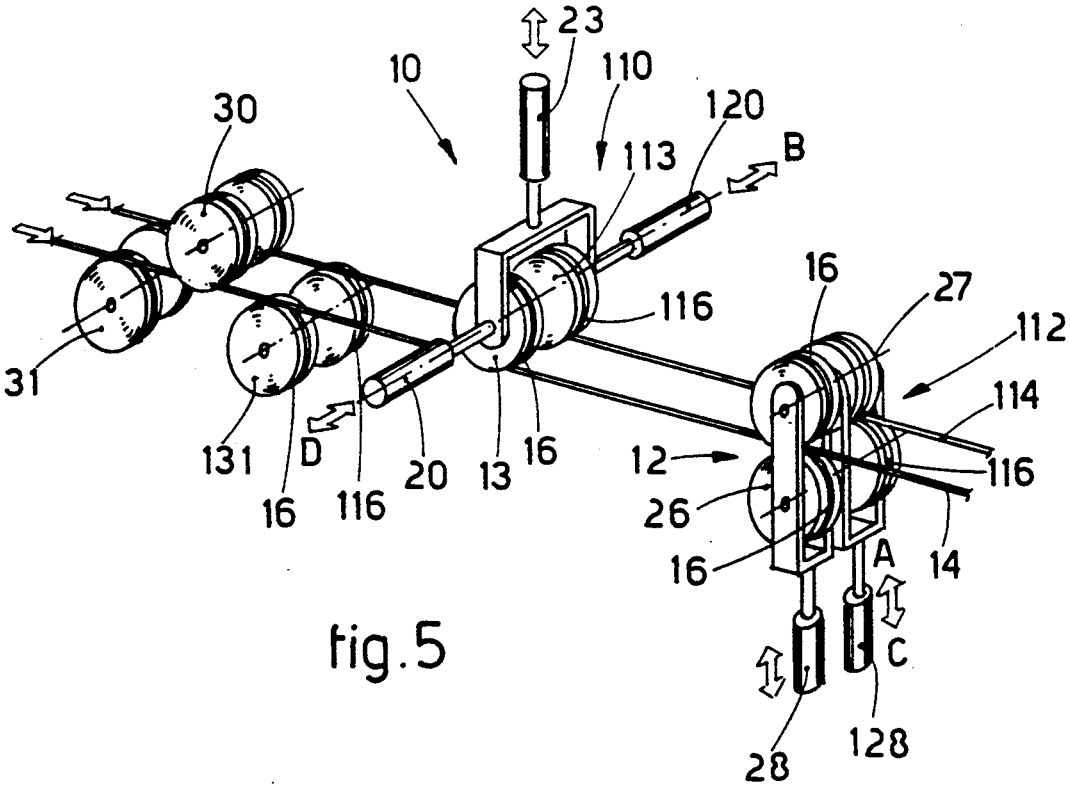

Let us see some particular embodiments of the invention with the help of the attached figures, which are given as a non-restrictive example and in which:

FIGS. 1*a* and 1*b* show the state of the art;

FIGS. 2, show a diagram of a general embodiment of the invention;

FIG. 3 gives a three-dimensional, partly cutaway view of a possible orthogonal adjustment unit;

FIG. 4 gives a diagram of a variant with two independent orthogonal adjustment units suitable to process two bars at the same time;

FIG. 5 show a variant of the embodiment of FIG. 4.

In the FIGS. a bar 14 with a direction of feed according to the arrow 15 is passed through a straightening assembly 11 at the downstream end of which are comprised rolls 30 (here an upper roll) and 31 and 131 (here lower rolls). The row of powered rolls may be the row including the upper roll 30 or the lower rolls 31-131 or both rows of rolls.

A contrast unit 12 is located downstream of the straightening assembly 11 and in this example has the functions of a measurement unit and comprises an upper roll 27 and lower roll 26. These rolls 26–27 are thrust resiliently against each other advantageously.

The rolls of the straightening assembly 11 and the rolls of the contrast measurement unit 12 in this case advantageously lie substantially on the same plane.

The orthogonal adjustment unit 10 is included between the last downstream roll 131 of the straightening assembly 11 and the contrast measurement unit 12. The orthogonal adjustment unit 10 comprises an adjustment roll 13 able to move in four directions along two cartesian axes that generate planes cooperating with the axis of the bar 14.

These cartesian axes (A-C and B-D) lie substantially on a plane perpendicular to the nominal axis of the machine and therefore of the bar 14.

According to the embodiment shown in FIGS. 2, 3 and 4 the adjustment roll 13 of the orthogonal adjustment unit 10 can move axially or in a direction normal to its own axis and therefore along axes perpendicular to the axis of the bar 14.

The movement which the adjustment roll 13 can carry out induces in the bar 14 leaving the contrast measurement unit 12 any three-dimensional position contained in a conoid 29 having at its vertex a position between the two rolls 26-27 of the contrast measurement unit 12. This means that if the adjustment roll 13 is thrust, for instance, along the axis C, the position taken up by the bar 14 in the conoid 29 will be that corresponding to a direction contrary to the direction C, namely the direction marked with A' in FIG. 2.

Analogously an axial movement of the adjustment roll 13 along the axis D will induce a displacement of the bar 14 in the direction B' in the conoid 29.

It is possible to identify by analogy the directions of the bar 14 induced instead by other displacements of the adjustment roll 13.

The degree of displacement of the adjustment roll 13 will obviously induce an analogous degree of displacement within the conoid 29 when the curved loop induced on departure from the straightening assembly 11 has been taken up.

The scope of the invention provides for the embodiment of FIG. 2 to be arranged as a symmetrical counterpart of the embodiment as shown in FIG. 2.

Let us now see some examples of the embodiment in more detail.

A possible orthogonal adjustment unit 10 is shown in FIG. 3, wherein the adjustment roll 13 comprises a circumferential crown 16, within which the bar 14 is partly engaged, and is supported so as to be able to idle by a flange 17 which is solidly fixed to a rotation-prevention shaft 18.

The rotation-prevention shaft 18 is free to slide axially in a slider element 21 and is positioned axially by a first threaded shaft 19 driven in turn by a first motor 20.

The slider element 21 is able to slide in appropriate guides in a frame 24 and is moved vertically by a second threaded shaft 22 driven by a second motor 23.

Thus, owing to the drives of the first and second motors 20–23 the adjustment roll 13 can be displaced along the axis B–D or along the axis A-C as required.

When two bars 14 are straightened at the same time, the problem arises as to how to handle the two bars 14 independently since both of them may have specific straightening requirements; in this case it is possible to employ the embodiment of FIG. 4, which provides for the doubling of the embodiment of FIG. 3 and in which two adjustment rolls 13 and 113 cooperate with the respective bars 14 and 114.

In practice the first motor 20 (or 120) which drives the adjustment roll 13 (or 113) more exposed to the bending loop may be placed elsewhere and the relative command may be transferred by known transmission means.

In FIG. 4 both the rolls 13-113 with their respective rotation-prevention shafts 18-118 are independent and can be moved along the axis A-C or B-D by the respective first and second motors 20-30 and 120-123 by means of the slider elements 21-121 with the relative second threaded shafts 22-122 and by means of the first threaded shafts 19-119.

A support 25 enables the duplicate orthogonal adjustment unit 110 to be properly supported in cooperation with the original orthogonal adjustment unit 10.

FIG. 5 shows the embodiment of a variant in which it is possible to obtain the function performed by the twin unit of FIG. 4. In FIG. 5 the orthogonal adjustment unit 10 comprises two independent adjustment rolls 13-113 which can move independently in relation to their own axis of rotation.

If so required, both the adjustment rolls 13-113 can be supported on one single support, which makes it possible to move them also according to their vertical axis by means of the second motor 23.

But in the case of FIG. 5 it is necessary for the contrast measurement units 12–112 to be movable independently, for instance by means of third motors 28–128 on a vertical plane.

In the case of FIG. 5, therefore, the adjustment rolls 13–113 are undoubtedly able to move independently along the axis B–D, while the contrast measurement units 12-112 can move independently along the axis A-C.

By means of this variant, which can also be applied in the event of a single bar, it is possible to obtain a variant of the idea of the basic solution while keeping unchanged the method of the orthogonal adjustment in the straightened bar 14.

According to the invention the method therefore arranges that after the straightening and immediately downstream of the straightening assembly a desired and variable deformation which is opposed to the curved development produced by the three downstream rolls of the straightening assembly is imparted to the bar.

According to the invention too the deformation imparted to the bar acts radially on the bar in a desired position, within a full circle of 360°, lying on a plane normal to the nominal axis of the bar.

We claim:

1. A bar straightening machine through which bars pass along a nominal axis and having an orthogonal adjustment unit, comprising:

a straightening assembly having a plurality of rolls arranged in first and second rows with said nominal axis passing between said first and second rows, rolls of said first row being opposed to and staggered with rolls of said second row, and at least a plurality of said rolls being powered;

a contrast unit provided downstream of said straightening assembly and comprising at least a pair of opposing rollers, a first plane perpendicular to the axes of said opposing rollers and passing through said opposing rollers being substantially the same as a plane passing through said rolls of said straightening assembly and perpendicular to the axes of said rolls of said straightening assembly; and an orthogonal adjustment unit provided between said straightening assembly and said contrast unit, said orthogonal adjustment unit comprising at least one adjustment roll capable of idling and of being movable along two orthogonal axes, each of which is perpendicular to said nominal axis, such that said adjustment roll is positionable as required within an angle of 360° on a plane normal to said nominal axis, said at least one adjustment roll being provided such that a plane passing through said adjustment roll and perpendicular to the axis of said adjustment roll is parallel to or coinciding with said first plane, wherein said orthogonal adjustment unit can impart a desired variable deformation to a bar passing through said straightening assembly and said contrast unit so as to oppose a curved development imparted to said bar by said straightening assembly.

2. A straightening machine as claimed in claim 1, wherein said at least one adjustment roll is fitted to two orthogonal elements each of which can be moved reciprocally.

3. A straightening machine as claimed in claim 1, wherein said straightening assembly comprises two opposed rows of rolls, the rolls of one row being staggered along said nominal axis with the rolls of the opposing row, said one row having at least two rolls and said opposing row having at least three rolls.

4. A straightening machine as claimed in claim 3, wherein at least one of the one row and the opposing row are powered.

5. A straightening machine enabling orthogonal adjustment of bars passing therethrough along a nominal axis, comprising:

a straightening assembly having a plurality of rolls arranged in first and second rows with said nominal axis passing between said first and second rows, rolls of said first row being opposed to and staggered with rolls of said second row, and at least a plurality of said rolls being powered;

a contrast unit comprising a pair of opposed rolls provided downstream of said straightening assembly, a first plane perpendicular to the axes of said pair of opposed rolls and passing through said pair of opposed rolls being substantially the same as a plane perpendicular to the axes of said rolls of said straightening assembly and passing through said rolls of said straightening assembly; and an idler adjustment roll provided between said straightening assembly and said contrast unit such that a plane perpendicular to the axis of said idler adjustment roll and passing through said idler adjustment roll is substantially the same as or parallel to said first plane, said idler adjustment roll being capable of movement in at least one direction along its axis;

wherein, said contrast unit is capable of movement substantially normal to said at least one direction along which said idler adjustment roll is movable so that said idler adjustment roll and said contrast unit can impart a desired variable deformation to a bar passing through said straightening assembly and said contrast unit so as to oppose a curved development imparted to said bar by said straightening assembly.

6. A straightening machine as claimed in claim 5, wherein said idler adjustment roll is capable of movement in a direction perpendicular to its axis and parallel to the movement of said contrast unit.

7. A straightening machine as claimed in claim 5, wherein said straightening assembly comprises two opposed rows of rolls, the rolls of one row being staggered along said nominal axis with the rolls of the opposing row, said one row having at least two rolls and said opposing row having at least three rolls.

8. A straightening machine as claimed in claim 7, wherein at least one of the one row and the opposing row are powered.

* * * * *